US005835070A

United States Patent [19]

Scaraglino

[11] Patent Number: 5,835,070

[45] Date of Patent: Nov. 10, 1998

[54] RETRACTABLE ANTENNA

[75] Inventor: Frank A. Scaraglino, Raleigh, N.C.

[73] Assignee: Ericsson Inc., Research Triangle Park, N.C.

[21] Appl. No.: 722,828

[22] Filed: Sep. 27, 1996

[51] Int. Cl.[6] ..... H01Q 1/44; H01Q 1/10; H01Q 1/50; H01Q 1/12

[52] U.S. Cl. ..... 343/877; 343/901; 343/903; 343/906; 343/856

[58] Field of Search ..... 343/877, 901, 343/903, 906, 856

[56] References Cited

U.S. PATENT DOCUMENTS

| | | | |
|---|---|---|---|
| 2,113,136 | 2/1938 | Hansell et al. | 343/823 |
| 3,163,863 | 12/1964 | Fujino | 343/877 |
| 4,117,495 | 9/1978 | Hochstein | 343/877 |
| 4,225,871 | 9/1980 | Ramari | 343/877 |
| 4,516,097 | 5/1985 | Munson et al. | 343/700 MS |
| 5,189,435 | 2/1993 | Yarsumas et al. | 343/903 |

FOREIGN PATENT DOCUMENTS

| | | |
|---|---|---|
| 0495507 A | 7/1992 | European Pat. Off. . |
| 1516762 | 8/1969 | Germany . |
| 26 41 236 | 3/1978 | Germany . |
| 02 159704 A | 6/1990 | Japan . |
| 05 283926 A | 10/1993 | Japan . |
| 07 084646 A | 3/1995 | Japan . |
| WO 95/11394 | 4/1995 | WIPO . |

*Primary Examiner*—Anita Pellman Gross
*Assistant Examiner*—Daniel St. Cyr
*Attorney, Agent, or Firm*—Nixon & Vanderhye P.C.

[57] ABSTRACT

A retractable antenna for a communications device includes a housing; an elongated, flexible antenna mast having an inner end and an outer free end; a take-up spool rotatably mounted in the housing, the inner end of the mast secured to the take-up spool; and a connector extending from the housing and adapted to be received in a communications device housing.

17 Claims, 2 Drawing Sheets

RETRACTABLE ANTENNA

TECHNICAL FIELD

This invention relates generally to mobile phones and like communication devices and, more specifically, to a retractable antenna for such devices.

BACKGROUND

Mobile phones, portable radios and like devices typically have elongated, flexible antennas which may or may not be retractable. Retractable antennas have the benefit of conserving space when the device is not in use. In the past, however, space had to be provided inside the device housing in order to accommodate the antenna in the axially retracted position. Alternatively, the antenna was mounted on the side of the housing, but this arrangement increased the external profile of the device.

DISCLOSURE OF THE INVENTION

This invention reduces the space required for an external antenna by providing a flexible retractable antenna which can be wound onto a relatively small take-up spool mounted in the antenna housing. In other words, no interior space is required inside the phone, radio or other transmitter/receiver housing (generally referred to herein as the "communications device"), and the exterior space required is minimized by the novel design of the invention.

In one exemplary embodiment, the antenna, which is easily installed or removed from the communications device by a conventional plug-in type connector, is provided with a housing adjacent the connector, within which a take-up spool is mounted for rotation. One end (the "inner" end) of the antenna mast is attached to the spool, and the antenna mast is sufficiently flexible that it can be pushed into the housing and wound onto the take-up spool to a retracted position. Conversely, the antenna can be pulled from the housing to an extended position. The mast itself has a generally flat shape, but may be slightly curved or crescent-shaped in cross section so as to add stiffness to the mast, allowing it to stand straight when extended. At the same time, the curved cross section does not interfere with, and in fact, enhances, the ability of the mast to wind and unwind on the take-up spool without lateral drift.

Electrical contact between the antenna and the communications device in a first embodiment is maintained by means of a pair of side-by-side coils in the antenna housing. One such coil may be mounted on an outside surface of an end flange of the take-up spool while an adjacent coil may be mounted on the inside of the housing sidewall. This latter coil also has a wire extending into the antenna connector plug for coupling with the device. The coil mounted on the take-up spool is in electro-magnetic contact with the adjacent coil on the housing wall but without mechanical engagement, so as to maintain electrical contact during winding and unwinding (retraction and extension) of the antenna and also, of course, in the fully extended and fully retracted positions. This arrangement reduces wear and creates less noise. The coils can also be used for impedence matching between antenna and communication device.

The antenna mast may include a folded dipole, but other antennas, e.g., coaxial, may be employed as well.

In a second exemplary embodiment, a pair of pick-up rings are mounted adjacent the spool end flanges, so as to maintain direct physical contact with the antenna mast at all times. One of the pick-up rings connects with a pick-up finger which, in turn, is connected to the plug-in type connector for the antenna. The other pick-up ring goes to ground.

In its broadest aspects, the invention relates to a communications device having a plug-in antenna, the antenna having a housing and a connector, the antenna movable between extended and retracted positions by winding on a spool located in the housing.

In another aspect, the invention thus provides a retractable antenna for a communications device comprising a housing; an elongated, flexible antenna mast having an inner end and an outer free end; a take-up spool rotatably mounted in the housing, the inner end of the mast secured to the take-up spool; and a connector extending from the housing and adapted to be received in the communications device.

In still another aspect, the invention provides a communication device including a first housing, and a retractable antenna removably connected to the first housing; the antenna comprising an inner end and an outer free end; a take-up spool rotatably mounted in a second housing forming part of the antenna, said inner end of the mast secured to the take-up spool; and a connector extending from the housing and adapted to be mate with a complementary connector in the communications device.

Objects and advantages other than those discussed above will become apparent from the detailed description which follows.

BEST MODE FOR CARRYING OUT THE INVENTION

Figure 2:
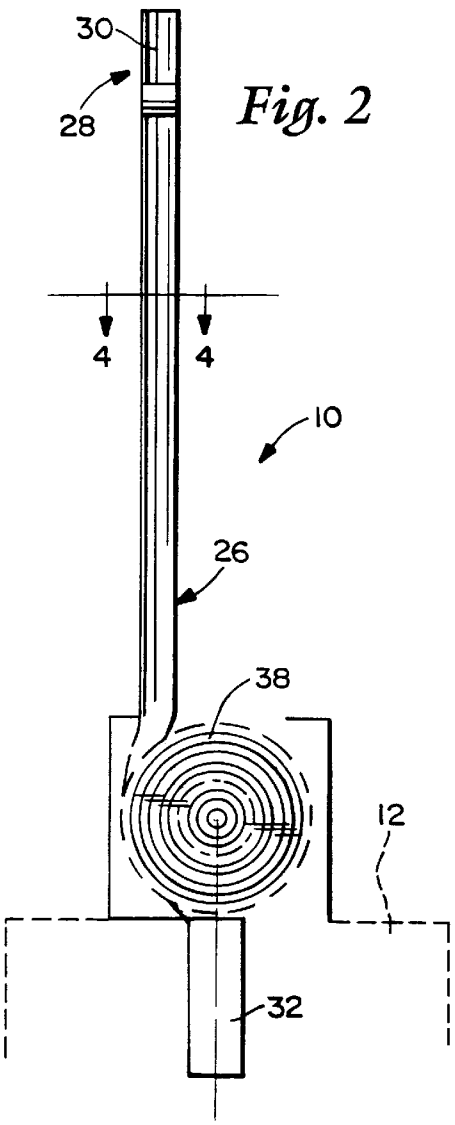
FIG. 2 is a side elevation of FIG. 1.

With reference now to FIGS. 1–4, an antenna 10 for a mobile phone (shown partly in phantom at 12) is illustrated and includes a housing 14 in which is mounted a take-up spool 16. The latter is mounted for rotation on a pin represented by axis 18 extending between opposite side walls of the housing. The take-up spool 16 may be of conventional construction, including a hub 20 and a pair of spaced, metal end flanges 22, 24.

A flexible antenna mast 26 has an inner end fixed to the hub 20 by any suitable means. An opposite, free end 28 is formed with an enlarged head 30 which prevents overwinding. The mast 26 may be made of any conventional antenna material, including spring steel. The mast is relatively thin, with a flattened profile. The mast is, however, preferably curved in cross section (see FIG. 4), which provides stiffness to the flexible material, permitting the mast to stand straight in the unwound or extended position. Mast 26 may also be made of polyamide, film or similar material.

Because of the relatively small and confining nature of the housing 14 and the relative size of the take-up spool 16, the antenna mast 26 can be pushed into the housing where it will be forced to wind onto the take-up spool, with each winding in nested relationship with adjacent windings as a result of the curved or crescent shaped cross-section of the mast. Friction is all that is needed to hold the antenna in the retracted position, and there is no need for springs or other biasing means.

The housing 14 is provided with a conventional plug-in type connector 32 which is received in a mating connector or socket 34 in the mobile phone housing 12.

Figure 1:
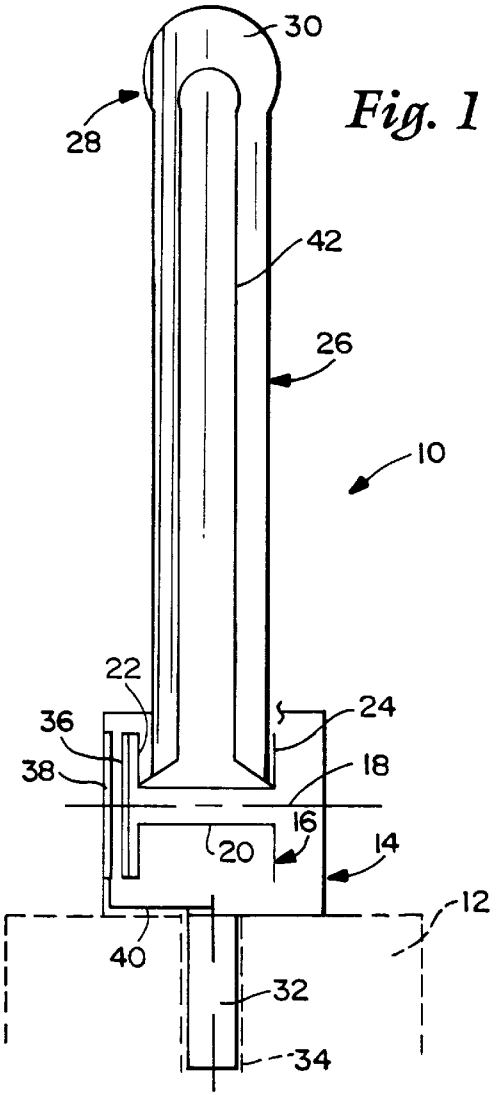
FIG. 1 is a simplified schematic diagram of a flexible, retractable antenna in accordance with a first embodiment of the invention.

In order to insure good electrical contact (i.e., rf coupling) between the antenna and the mobile phone, a first coil 36 is attached to the housing adjacent one of the spool flanges, e.g., 22 in FIG. 1. At the same time, a second coil 38 of similar construction, is mounted on the exterior side of flange 22, so that the side-by-side, parallel coils are spaced from each other but are in electro-magnetic contact. The coils 36 and 38 are preferably etched on PC boards but the invention is not necessarily limited to this arrangement. The coil 38 is electrically connected to the phone via wire 40. Thus, the arrangement of coils 36, 38 couples the radio frequency from the Rx/Tx port of the device 12 to the antenna. Note in the embodiment illustrated in FIGS. 1–4 that the antenna mast 26 encloses a folded dipole 42.

Figure 5:
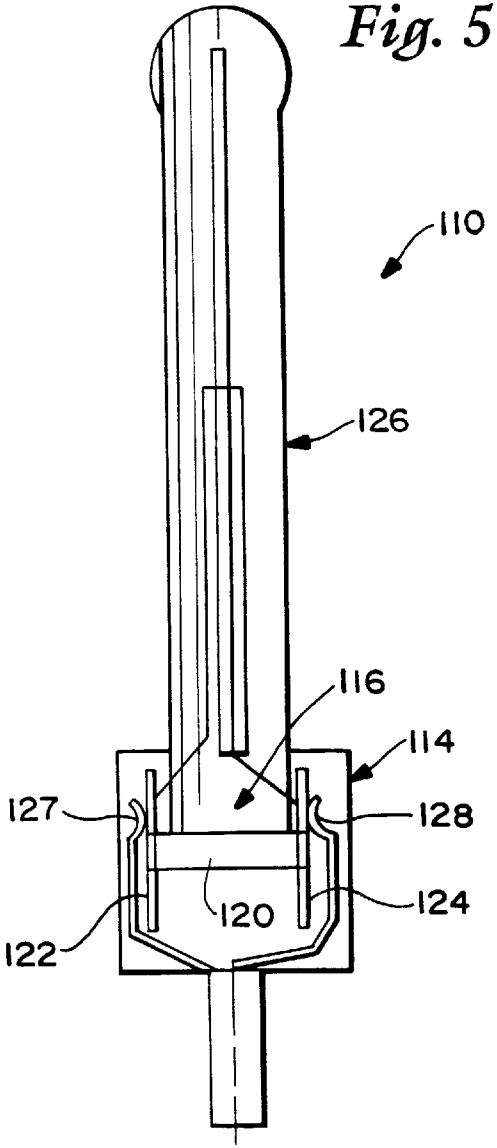
FIG. 5 is a simplified schematic diagram of a flexible, retractable antenna in accordance with a second embodiment of the invention.
Figure 4:
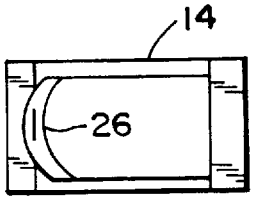
FIG. 4 is a cross section taken along the line 4—4 of FIG. 2.
Figure 3:
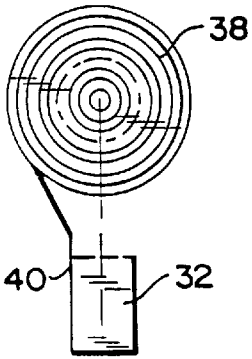
FIG. 3 is a side elevation of a coil mounted in the housing of the antenna shown in FIGS. 1 and 2.
Figure 6:
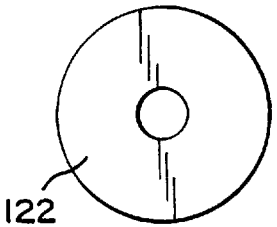
FIG. 6 is a side elevation of a connector ring used in the housing antenna shown in FIG. 5.

In the embodiment illustrated in FIGS. 5 and 6, the antenna 110 includes a housing 114 which mounts an interior take-up spool 116. The spool hub 20 is mounted on a plastic pin or axle (not shown).

This embodiment differs from the first described embodiment insofar as a pair of pick-up rings 122 and 124 are mounted on the spool, thus enabling mechanical contact on both sides of the antenna at all times by means of a pair of pick-up fingers 127, 128. One of the rings is connected to the plug in connector while the other goes to ground. The antenna is otherwise similar in terms of its extension and retraction motion to the earlier described embodiment.

The flexible antenna mast 126 may be similar to mast 26 or may be of any conventional antenna construction (folded dipole or, coaxial as shown in FIG. 5).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A retractable antenna for a communications device comprising:

a housing;

an elongated, flexible antenna mast having an inner end and an outer free end;

a take-up spool rotatably mounted in the housing, said inner end of said mast secured to said take-up spool;

a connector extending from said housing and adapted to be received in the communications device; and a first coupling coil attached to said take-up spool and a second coupling coil attached to said housing, said first and second coils spaced from each other but in electro-magnetic contact, with said second coupling coil electrically connected to said communication device via said connector.

2. The antenna of claim 1 wherein said mast is curved in a cross section taken perpendicular to a longitudinal axis thereof.

3. The antenna of claim 1 wherein said mast is comprised of spring steel.

4. The antenna of claim 1 wherein said mast is comprised of polyamide film.

5. The antenna of claim 1 wherein said take-up spool is mounted on a pin for rotation about an axis perpendicular to a longitudinal axis of the mast.

6. The antenna of claim 1 wherein said mast is movable between an extended position and a retracted position, and, when in said retracted position, said mast is wound on said take-up spool.

7. The antenna of claim 1 wherein said mast is movable between a substantially axially oriented extended position and a coiled retracted position, and wherein said mast is held in either position substantially only by friction.

8. The antenna of claim 7 wherein said mast is curved in a cross section taken perpendicular to a longitudinal axis thereof.

9. A retractable antenna for a communications device comprising:

a housing;

an elongated, flexible antenna mast having an inner end and an outer free end;

a take-up spool rotatable mounted in the housing, said inner end of said mast secured to said take-up spool;

a connector extending from said housing and adapted to be received in the communications device; and a pair of connector rings mounted on said take-up spool for establishing physical contact with the antenna mast, and a pair of pick-up fingers connected between said rings and said connector.

10. The antenna of claim 9 wherein said antenna comprises a folded dipole.

11. A communication device including a first housing, and a retractable antenna removably connected to said first housing; said antenna comprising an inner end and an outer free end; a take-up spool rotatably mounted in a second housing forming part of said antenna, said inner end of said mast secured to said take-up spool; a connector extending from said housing and adapted to mate with a complementary connector in the communications device; and a first coupling coil attached to said take-up spool and a second coupling coil attached to said housing, said first and second coils spaced from each other but in electro-magnetic contact, with said second coupling coil electrically connected to said communication device via said connector.

12. The communications device of claim 11 wherein said mast is curved in a cross section taken perpendicular to a longitudinal axis thereof.

13. The antenna of claim 11 wherein said mast is comprised of spring steel.

14. The antenna of claim 11 wherein said mast is comprised of polyamide film.

15. The antenna of claim 11 wherein said take-up spool is mounted for rotation about an axis perpendicular to a longitudinal axis of the mast.

16. The antenna of claim 11 wherein said mast is movable between an extended position and a retracted position, and, when in said retracted position, said mast is wound on said take-up spool.

17. The device of claim 11 wherein coupling between the antenna mast and the connector is established by a pair of pick-up rings mounted on said take-up spool and in contact with said antenna, and a pair of pick-up fingers respectively engaged with said pick-up rings.

* * * * *